US005734316A

United States Patent [19]

Swanson, Jr.

[11] Patent Number: 5,734,316

[45] Date of Patent: Mar. 31, 1998

[54] CANINE AUDITORY TRANSMISSION APPARATUS

[76] Inventor: Ronald E. Swanson, Jr., 620 Elwood Dr., Eugene, Oreg. 97401

[21] Appl. No.: 767,201

[22] Filed: Dec. 16, 1996

[51] Int. Cl.[6] ..... G08B 3/00

[52] U.S. Cl. ..... 340/384.3; 340/426; 340/460; 340/539; 340/573; 340/692; D26/37; D26/48; D3/224; D3/228; D3/208

[58] Field of Search ..... 340/384.3, 426, 340/460, 539, 573, 691, 692, 693, 540, 541; D26/37, 38, 48; D3/224, 228, 226, 207, 208

[56] References Cited

U.S. PATENT DOCUMENTS

| | | | |
|---|---|---|---|
| D. 359,165 | 6/1995 | Kaiser, III | D3/228 |
| D. 373,208 | 8/1996 | Yuen | D26/38 |
| 3,740,737 | 6/1973 | Carleson | 340/573 |
| 3,901,571 | 8/1975 | Begitschke et al. | 312/257 R |
| 4,023,151 | 5/1977 | Markham . | |
| 4,212,007 | 7/1980 | Reyes et al. | 340/691 |
| 4,218,763 | 8/1980 | Kelley et al. | 340/539 |
| 4,571,583 | 2/1986 | Giordano . | |
| 4,606,073 | 8/1986 | Moore | 340/539 |
| 4,970,489 | 11/1990 | Jenkins et al. | 340/573 |
| 5,220,319 | 6/1993 | Kendel | D3/62 |
| 5,463,595 | 10/1995 | Rodhall et al. | 340/573 |
| 5,473,305 | 12/1995 | Hwang . | |
| 5,630,206 | 5/1997 | Urban et al. | 340/426 |

*Primary Examiner*—Jeffery Hofsass
*Assistant Examiner*—Nina Tong
*Attorney, Agent, or Firm*—Michael I. Kroll

[57] ABSTRACT

A first method (210) of utilizing a canine auditory transmission apparatus (10) having of the following steps: A) arriving (212) at a potential crime scene; B) placing (212), by extending and holding a housing retractable handle (12A), the canine auditory transmission apparatus (10) on a metal surface; C) allowing (216) a housing magnet (12D) of a housing (12) to securely attach to the metal surface and further allowing the housing retractable handle (12A) to retract therein; D) first activating (218) a ON/OFF switch (14) to an ON position which electronically connects a power means (22) to a microchip (20) which is electronically connected to a receiver (21), the microchip (20) is further electronically connected to at least one speaker (18) and an audio player (17); E) checking (220) if a power indicator light (16) is illuminated; F) adjusting (222) a volume control (15); G) depressing (224) a remote unit ON button (24E) of a remote unit (24), the remote unit (24) comprises a remote unit housing (24A) containing a remote unit transmitter (24B) electronically connected to a remote unit microchip (24C) electronically connected to a remote unit power means (24D) electronically connected to a remote unit OFF button (24F) electronically connected to a remote unit volume control button (24G) electronically connected to the remote unit ON button (24E); H) first sending (226) a signal from the remote unit transmitter (24B) to the receiver (21); and I) second activating (228) the audio player (17) which transmits canine sounds from the at least one speaker (18), the canine sounds are selected from a group consisting of whining, fierce barking, and random single barks.

5 Claims, 7 Drawing Sheets

CANINE AUDITORY TRANSMISSION APPARATUS

BACKGROUND OF THE INVENTION

1. Field of the Invention

The present invention relates to canine auditory transmission apparatus to deter and/or prevent a dangerous situation. More particularly, the present invention relates to canine auditory transmission apparatus having a remote unit which can be activated by a policeman.

2. Description of the Prior Art

Police officers utilizing well trained canines are and were historically less likely to be assaulted as well as more likely to apprehend a criminal in comparison to police officers working alone. However, the cost of canines as well as care associated therewith for each member of the police force is cost prohibitive. Therefore, there exists a need for a simulated canine as a deterrent to attempt to emulate the goals achieved by the canines. To date, there are no portable or vehicle mounted canine simulating inventions.

Numerous innovations for recording and playing devices are present in the prior art. Even though these innovations may be suitable for the specific individual purposes to which they address, they would not be suitable for the purposes of the present invention as heretofore described.

SUMMARY OF THE INVENTION

The present invention relates to canine auditory transmission apparatus to deter and/or prevent a dangerous situation. More particularly, the present invention relates to canine auditory transmission apparatus having a remote unit which can be activated by a policeman. The intended use is to mimic the presence of actual K-9 police dogs until back-up policeman arrive on the scene. The present invention is to be used primarily by law enforcement and is designed to manipulate and discourage a person's thought process to not run, assault or possibly kill a police officer while he/she is working the streets. The present invention is designed to give the police the advantage of working with a K-9 partner until cover arrives.

Directions: The Back-up Barker is a portable device, but it can also be mounted to a fixed object. With the magnetic speaker base, the Back-up Barker can be placed on any metal platform. The Back-up Barker can be activated before or after the police officer makes a contact. The Back-up Barker can be activated manually or by remote control device.

The present invention can sit next to the police officer while the police officer is working in his patrol vehicle. When the police officer makes his/her stop, the canine auditory transmission apparatus should be mounted in a concealed way behind the overhead light bar or on the trunk of the patrol car. Depending on the situation, the canine auditory transmission apparatus can be activated manually or by the remote control.

The canine auditory transmission apparatus can be mounted on a metal plate that is attached to the rear dashboard, and preferably near the left rear door. The patrol car rear windows should be tinted with dark window tape so the public can't see what's in the back seat, but only hear the sound of a K-9 dog whining and barking. The police officer should activate The Back-up Barker with the remote control if it is attached to the rear metal plate.

The present invention has a handle and can also have a detachable shoulder strap in case the police office is away from his car.

The canine auditory transmission apparatus can be utilized on vehicle traffic stops, person stops, riot control, building alarms, and setting up perimeters for fleeing suspects. The canine auditory transmission apparatus is very versatile and it can be used in many other ways, as well such as associated with burglar alarms.

The present invention is designed to discourage and manipulate a person's thought process from running, assaulting, or possibly killing a police officer. This product prevents a person from breaching a police perimeter while on the run, and allow police to control riot situations. Police officers encounter dangerous and hostile people on a regular basis. Most police departments don't have the finances to purchase police K-9 dogs as an extra safety tool for their police officers. The police departments that do have K-9 dogs see drastic changes in a person's demeanor when the K-9 dog arrives on scene. When K-9 dogs bark, people generally abandon any thought of causing further problems with the officers on scene. The K-9 dog's bark is a fantastic psychological deterrent to people wanting to commit crimes. Many departments also are short on man power. Consequently the arrival time for a back-up unit often can be up to 45 minutes in some rural areas. This product is the K-9 dog for the police departments that can't afford the luxury of having the real dog on scene. This product, if used correctly will cause people to think the real K-9 dog(s) are on scene. The intent of this product is to protect the police officers who work the dangerous streets of our nation. To provide them with an extra tool to keep them always a step ahead of the criminals. Making it home to their families another day.

The types of problems encountered in the prior art are police officers working alone are in greater danger than ones working with a K-9.

In the prior art, unsuccessful attempts to solve this problem were attempted namely: purchasing or training additional K-9's. However, the problem was solved by the present invention because the cost is greatly reduced utilizing the present invention.

Innovations within the prior art are rapidly being exploited in the field of law enforcement.

The present invention went contrary to the teaching of the art which describes live canines.

The present invention solved a long felt need for a portable device which a police officer can activate to simulate the presence of a K-9.

The present invention produced unexpected results namely: offenders were less likely to flee a scene and/or assault a police officer.

A synergistic effect was produced utilizing the present invention due to the following facts and results from experimentation: by incorporating the present invention into security alarm systems, thieves were greatly deterred from entering homes with a canine security device.

Accordingly, it is an object of the present invention to provide a canine auditory transmission apparatus.

More particularly, it is an object of the present invention to provide a canine auditory transmission apparatus having a housing comprising a housing retractable handle, a housing CD storage container, housing indicia, a housing magnet, a housing front, an ON/OFF switch, a volume control, and a power indicator light.

In keeping with these objects, and with others which will become apparent hereinafter, one feature of the present invention resides, briefly stated, in the housing containing an audio player, a speaker, a microchip, a receiver, and a power means.

When the power means is designed in accordance with the present invention, it is rechargeable by a cigarette lighter adapter.

In accordance with another feature of the present invention, a vehicle mounted canine auditory transmission apparatus.

Another feature of the present invention is that the vehicle mounted canine auditory transmission apparatus comprises a vehicle mounted housing containing a vehicle mounted receiver, a vehicle mounted audio player, and a vehicle mounted volume control.

Yet another feature of the present invention is that the vehicle mounted canine auditory transmission apparatus comprises at least one vehicle mounted speaker and a vehicle mounted power means which are positioned external to the vehicle mounted housing.

Still another feature of the present invention is that a remote unit comprises a remote unit housing containing a remote unit transmitter, a remote unit microchip, a remote unit power means, a remote unit ON button, a remote unit OFF button, and a remote unit volume control button.

Yet still another feature of the present invention is that the remote unit housing is attached to a remote unit chain which is attached to a remote unit key ring.

Still yet another feature of the present invention is that the remote unit is removably insertable into a snap on gun belt remote unit holder.

Another feature of the present invention is that the snap on gun belt remote unit holder comprises a snap on gun belt remote unit holder cylinder, and a snap on gun belt remote unit holder strap having a snap on gun belt remote unit holder strap male snap and a snap on gun belt remote unit holder strap female snap connectable to the snap on gun belt remote unit holder cylinder by a snap on gun belt remote unit holder strap fastener.

Yet another feature of the present invention is that the remote unit is removably insertable into a clip on belt remote unit holder.

Still another feature of the present invention is that the clip on belt remote unit holder comprises a clip on belt remote unit holder cylinder, a clip on belt remote unit holder clip having a clip on belt remote unit holder clip top member connected to a clip on belt remote unit holder clip bottom member by a clip on belt remote unit holder clip angled member.

Yet still another feature of the present invention is that the clip on belt remote unit holder clip top member is securely fastened to the clip on belt remote unit holder cylinder by at least one clip on belt remote unit holder clip top member fastener.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

First Embodiment

10—canine auditory transmission apparatus (10)
12—housing (12)
12A—housing retractable handle (12A)
12B—housing CD storage container (12B)
12C—housing indicia (12C)
12D—housing magnet (12D)
14—ON/OFF switch (14)
15—volume control (15)
16—power indicator light (16)
17—audio player (17)
18—speaker (18)
19—cigarette lighter adapter (19)
20—microchip (20)
21—receiver (21 )
22—power means (22)

Second Embodiment

110—vehicle mounted canine auditory transmission apparatus (110)
112—vehicle mounted housing (112)
112A—vehicle mounted receiver (112A)
114—vehicle mounted speaker (114)
116—vehicle mounted power means (116)
120—vehicle mounted adjuster (120)

Components Common To Embodiments

24—remote unit (24)
24A—remote unit housing (24A)
24B—remote unit transmitter (24B)
24C—remote unit microchip (24C)
24D—remote unit power means (24D)
24E—remote unit ON button (24E)
24F—remote unit OFF button (24F)
24G—remote unit volume control button (24G)
24H—remote unit chain (24H)
24I—remote unit key ring (24I)
26—snap on gun belt remote unit holder (26)
26A—snap on gun belt remote unit holder cylinder (26A)
26B—snap on gun belt remote unit holder strap (26B)
26BA—snap on gun belt remote unit holder strap male snap (26BA)
26BB—snap on gun belt remote unit holder strap female snap (26BB)
26BC—snap on gun belt remote unit holder strap fastener (26BC)
28—clip on belt remote unit holder (28)
28A—clip on belt remote unit holder cylinder (28A)
28B—clip on belt remote unit holder clip (28B)
28BA—clip on belt remote unit holder clip top member (28BA)
28BB—clip on belt remote unit holder clip bottom member (28BB)
28BC—clip on belt remote unit holder clip angled member (28BC)
28BBA—clip on belt remote unit holder clip top member fastener (28BBA)

FIRST METHOD (210) OF UTILIZING A CANINE AUDITORY TRANSMISSION APPARATUS (10)

A) arriving (212) at a potential crime scene;

B) placing (214), by extending and holding a housing retractable handle (12A), the canine auditory transmission apparatus (10) on a metal surface;

C) allowing (216) a housing magnet (12D) of a housing (12) to securely attach to the metal surface and further allowing the housing retractable handle (12A) to retract therein;

D) first activating (218) a ON/OFF switch (14) to an ON position which electronically connects a power means (22) to a microchip (20) which is electronically connected to a receiver (21), the microchip (20) is further electronically connected to at least one speaker (18) and an audio player (17);

E) checking (220) if a power indicator light (16) is illuminated;

F) adjusting (222) a volume control (15);

G) depressing (224) a remote unit ON button (24E) of a remote unit (24), the remote unit (24) comprises a remote unit housing (24A) containing a remote unit transmitter (24B) electronically connected to a remote unit microchip (24C) electronically connected to a remote unit power means (24D) electronically connected to a remote unit OFF button (24F) electronically connected to a remote unit volume control button (24G) electronically connected to the remote unit ON button (24E);

H) first sending (226) a signal from the remote unit transmitter (24B) to the receiver (21);

I) second activating (228) the audio player (17) which transmits canine sounds from the at least one speaker (18), the canine sounds are selected from a group consisting of whining, fierce barking, and random single barks;

J) pressing (230) the remote unit volume control button (24G);

K) second sending (232) a signal from the remote unit transmitter (24B) to the receiver (21); and L) third activating (234) the audio player (17) which adjusts volume of transmission of the canine sounds from the at least one speaker (18).

SECOND METHOD (310) OF UTILIZING A VEHICLE MOUNTED CANINE AUDITORY TRANSMISSION APPARATUS (110)

A) arriving (312) at a potential crime scene;

B) first activating (314) a vehicle mounted power means (116) which electronically connects a vehicle mounted receiver (112A) and electronically connects a vehicle mounted audio player (118) and electronically connects at least one vehicle mounted speaker (114), the vehicle mounted receiver (112A) and the vehicle mounted audio player (118) are contained within a vehicle mounted housing (112);

C) adjusting (316) a vehicle mounted volume control;

D) depressing (318) a remote unit ON button (24E) of a remote unit (24), the remote unit (24) comprises a remote unit housing (24A) containing a remote unit transmitter (24B) electronically connected to a remote unit microchip (24C) electronically connected to a remote unit power means (24D) electronically connected to a remote unit OFF button (24F) electronically connected to a remote unit volume control button (24G) electronically connected to the remote unit ON button (24E);

E) first sending (320) a signal from the remote unit transmitter (24B) to the vehicle mounted receiver (112A);

F) second activating (322) the vehicle mounted audio player (118) which transmits canine sounds from the at least one vehicle mounted speaker (114), the canine sounds are selected from a group consisting of whining, fierce barking, and random single barks;

G) pressing (324) the remote unit volume control button (24G);

H) second sending (326) a signal from the remote unit transmitter (24B) to the vehicle mounted receiver (112A); and I) third activating (328) the vehicle mounted audio player (118) which adjusts volume of transmission of the canine sounds from the at least one vehicle mounted speaker (114).

DESCRIPTION OF THE PREFERRED EMBODIMENT

Figure 1:
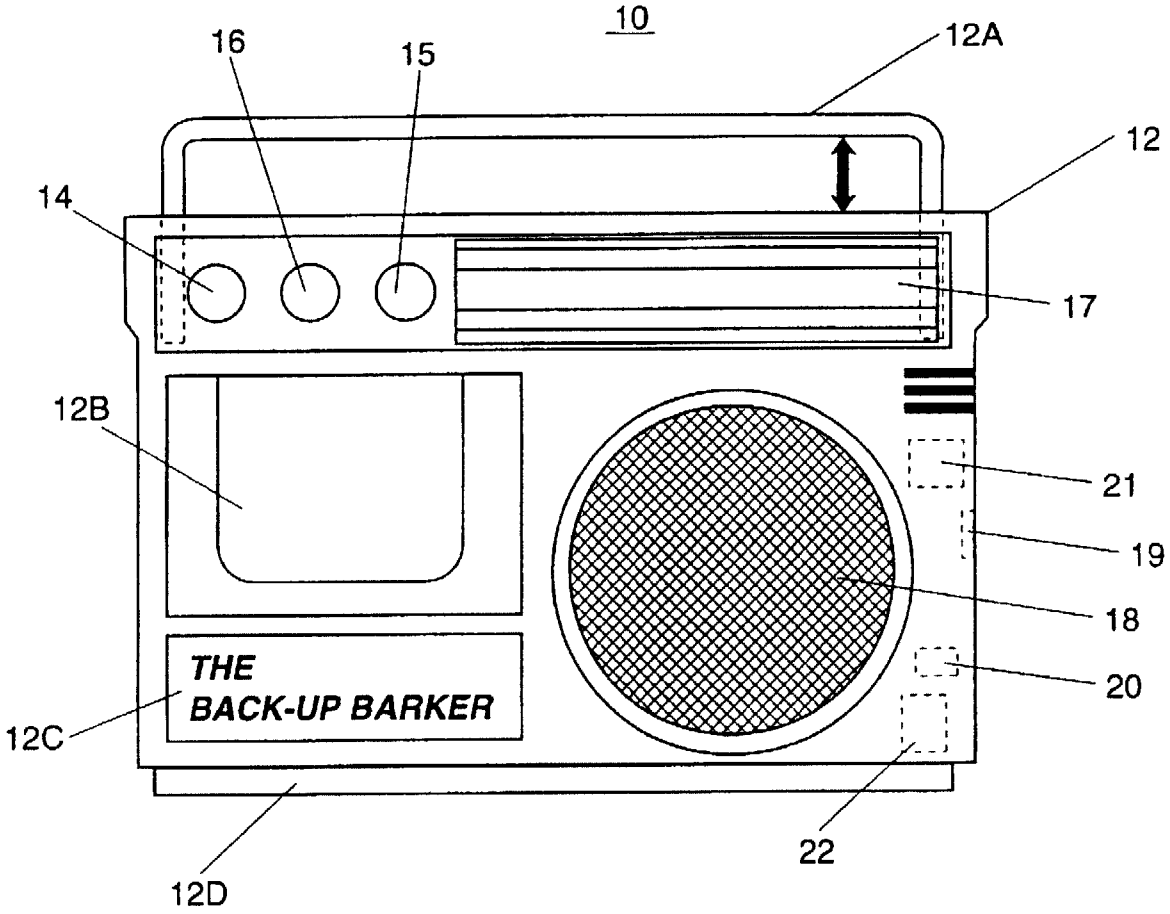
FIG. 1 is a front view of a housing front of a canine auditory transmission apparatus.
Figure 6:
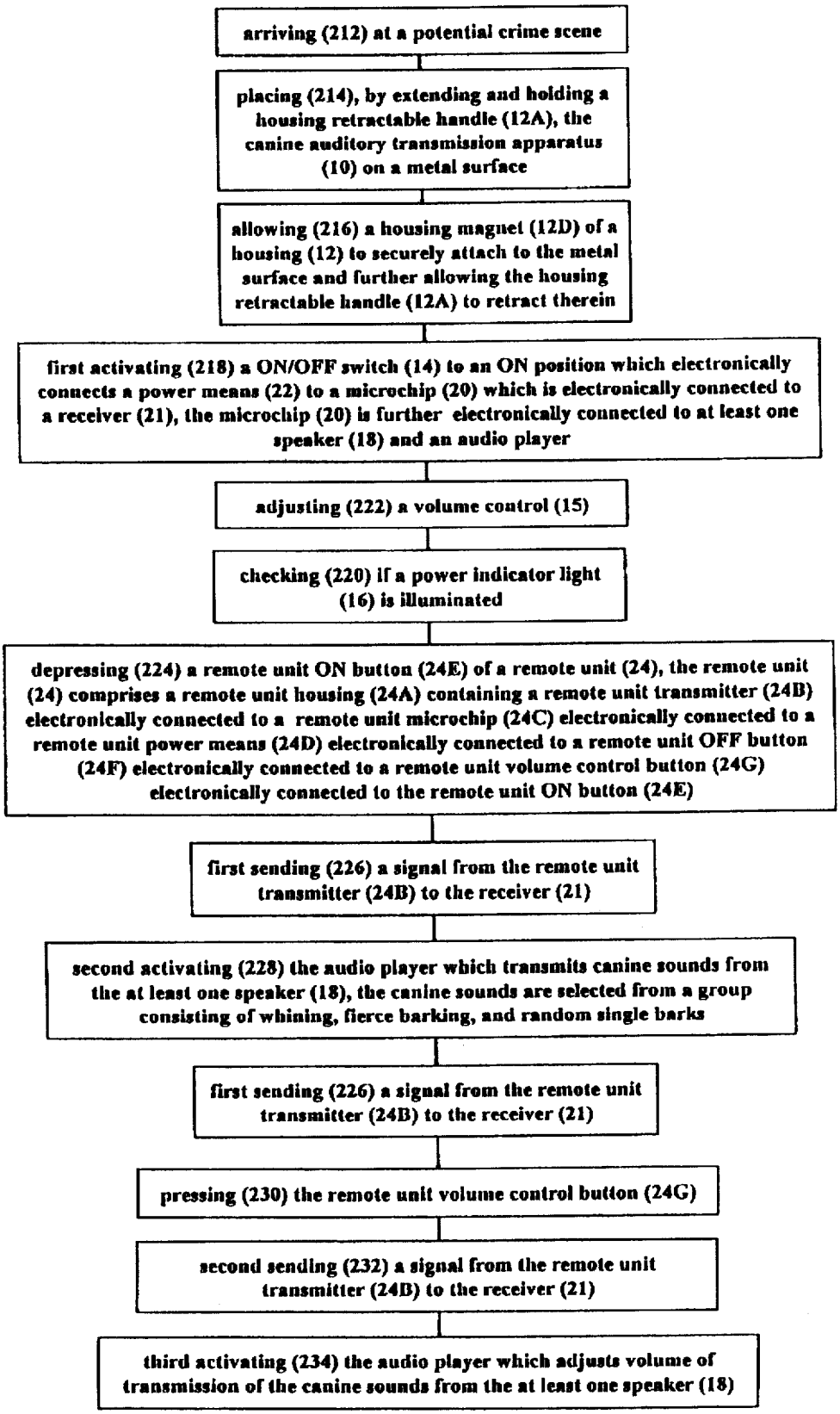
FIG. 6 is a diagrammatic representation of a first method of utilizing a canine auditory transmission apparatus.

Firstly, referring to FIG. 1 which is a front view of a housing front of a canine auditory transmission apparatus (10) and referring to FIG. 6 which is a diagrammatic representation of a first method (210) of utilizing a canine auditory transmission apparatus (10). The first method (210) of utilizing a canine auditory transmission apparatus (10) consists of the following steps:

A) arriving (212) at a potential crime scene;

B) placing (212), by extending and holding a housing retractable handle (12A), the canine auditory transmission apparatus (10) on a metal surface;

C) allowing (216) a housing magnet (12D) of a housing (12) to securely attach to the metal surface and further allowing the housing retractable handle (12A) to retract therein;

D) first activating (218) a ON/OFF switch (14) to an ON position which electronically connects a power means (22) to a microchip (20) which is electronically connected to a receiver (21), the microchip (20) is further electronically connected to at least one speaker (18) and an audio player (17);

E) checking (220) if a power indicator light (16) is illuminated;

F) adjusting (222) a volume control (15);

G) depressing (224) a remote unit ON button (24E) of a remote unit (24), the remote unit (24) comprises a remote unit housing (24A) containing a remote unit transmitter (24B) electronically connected to a remote unit microchip (24C) electronically connected to a remote unit power means (24D) electronically connected to a remote unit OFF button (24F) electronically connected to a remote unit volume control button (24G) electronically connected to the remote unit ON button (24E);

H) first sending (226) a signal from the remote unit transmitter (24B) to the receiver (21); and I) second activating (228) the audio player (17) which transmits canine sounds from the at least one speaker (18), the canine sounds are selected from a group consisting of whining, fierce barking, and random single barks.

The first method (210) of utilizing a canine auditory transmission apparatus (10) further consists of the steps of:

A) pressing (230) the remote unit volume control button (24G);

B) second sending (232) a signal from the remote unit transmitter (24B) to the receiver (21); and C) third activating (234) the audio player (17) which adjusts volume of transmission of the canine sounds from the at least one speaker (18).

The housing (12) further comprises a housing CD storage container (12B). The housing (12) further comprises housing indicia (12C) printed thereon. The power means (22) further comprises a cigarette lighter adapter (19) electronically connected to rechargeable Nicad batteries contained within the housing (12). Optionally, the power means can be at least one D cell alkaline battery. The power means (22) is electronically connectable to a cigarette lighter of a vehicle. The audio player (17) is selected from a group consisting of CD, ROM chip, and Dat. The audio player (17) preferably has at least thirty minutes of non-repeating audio sounds contained therein. The at least one speaker (18) comprises a specification of 85 Db to 102 Db @1w1m, with a frequency of 80 HZ to 18 KHZ, 6" to 8", comprising of either a one way or two way configuration up to 100 W power handling capability, and have a sufficient amplification of at least 76 dBSPL @ 8 meters. The housing (12) comprises dimensions in a range of 7 inches to 9 inches tall; 5 inches deep and 7 inches wide functioning to allow placement on a back dashboard of a vehicle without hitting the rear window.

Figure 2:
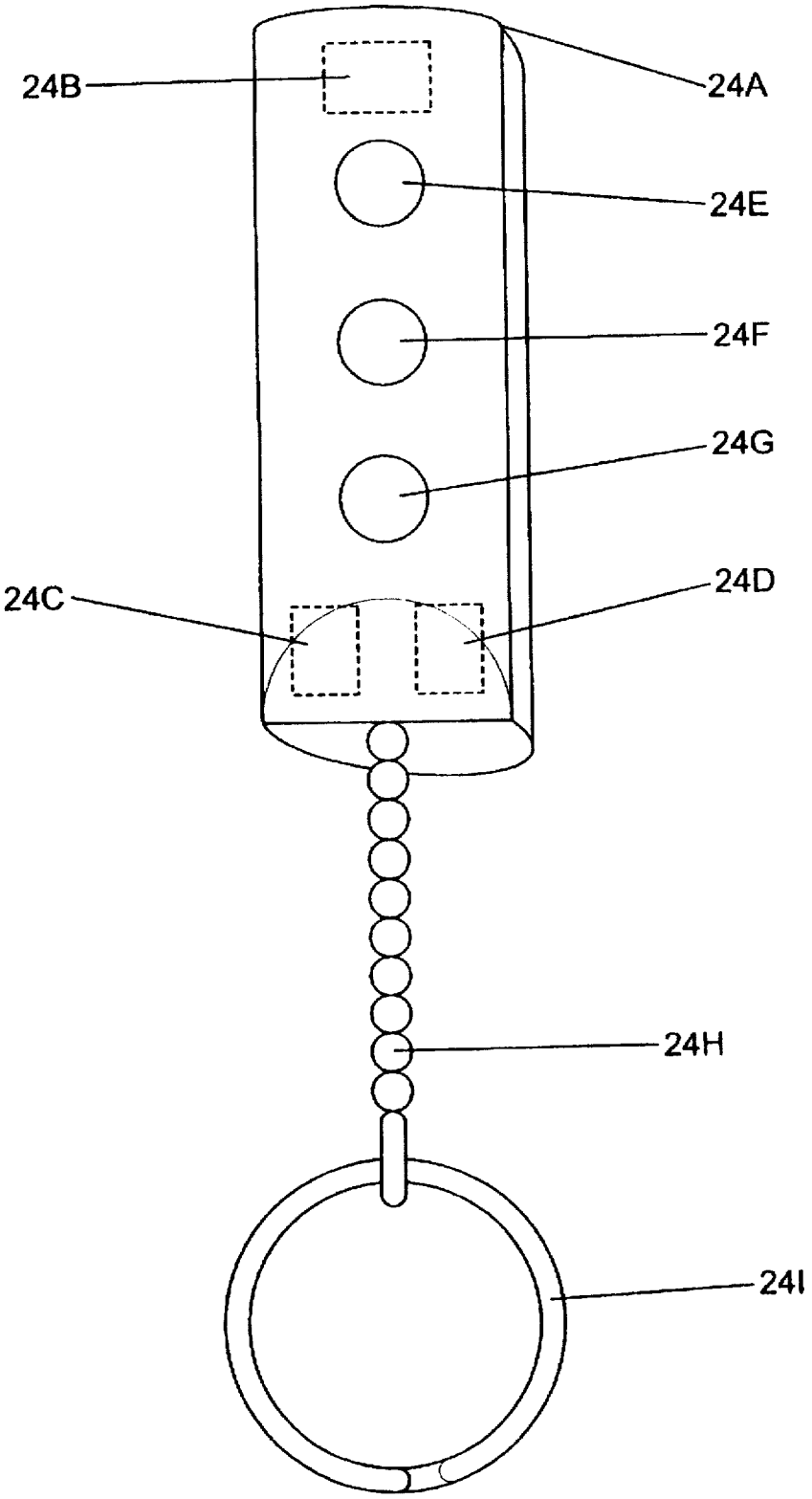
FIG. 2 is a front view of a remote unit.

Referring to FIG. 2 which is a front view of a remote unit (24). The remote unit (24) further comprises a remote unit chain (24H) securely fastened at one distal end and a remote unit key ring (24I) at an opposite distal end. The remote unit power means (24D) is preferably alkaline batteries but could optionally be rechargeable Nicad batteries.

Figure 3:
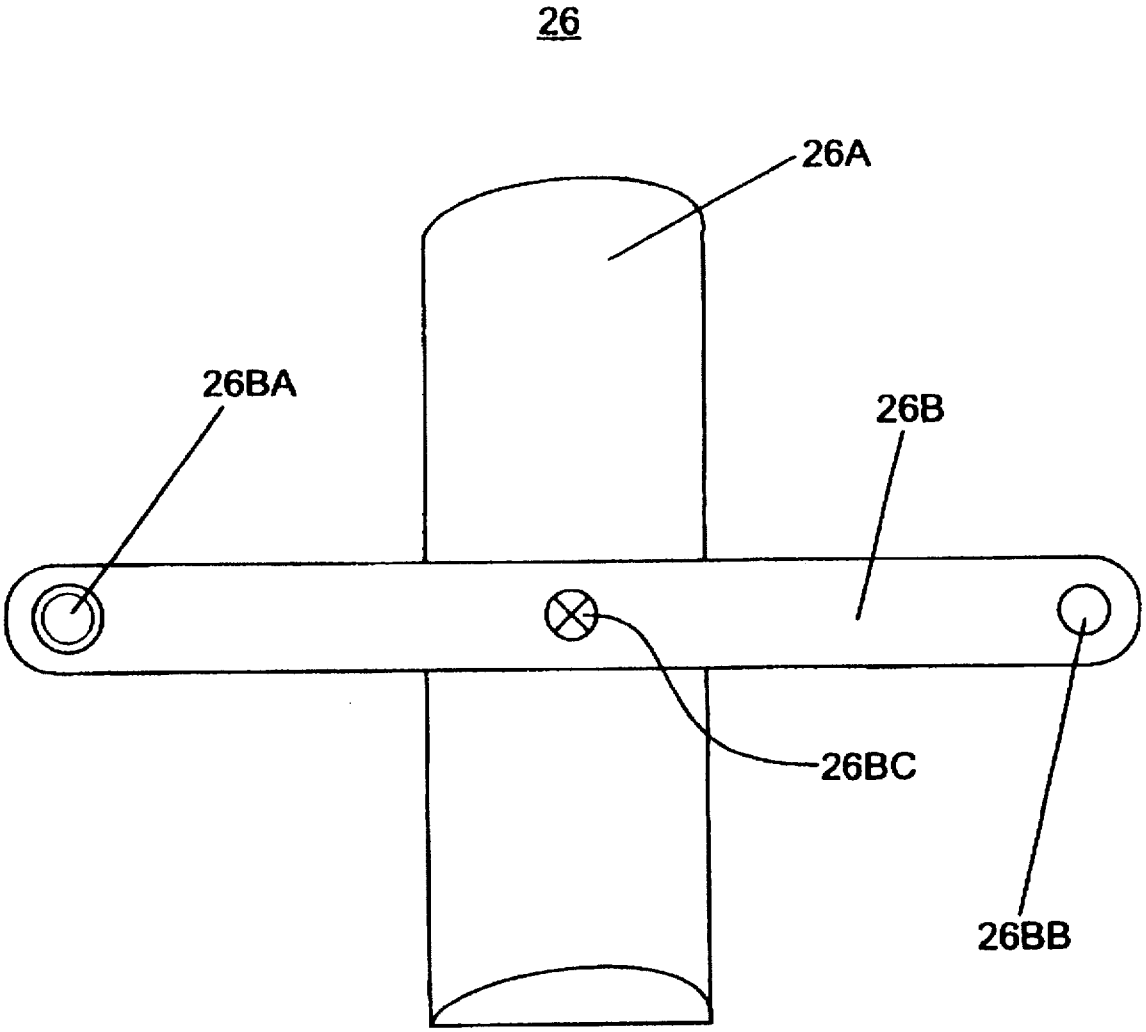
FIG. 3 is a front view of a snap on gun belt remote unit holder.

Referring to FIG. 3 which is a front view of a snap on gun belt remote unit holder (26) the remote unit (24) is removably position able within a snap on gun belt remote unit holder cylinder (26A) of a snap on gun belt remote unit holder (26) which comprises a snap on gun belt remote unit holder strap (26B) securely fastened by a snap on gun belt remote unit holder strap fastener (26BC) to the snap on gun belt remote unit holder cylinder (26A), the snap on gun belt remote unit holder strap (26B) comprises a snap on gun belt remote unit holder strap male snap (26BA) positioned at one distal end and a snap on gun belt remote unit holder strap female snap (26BB) positioned at an opposite distal end.

Figure 4:
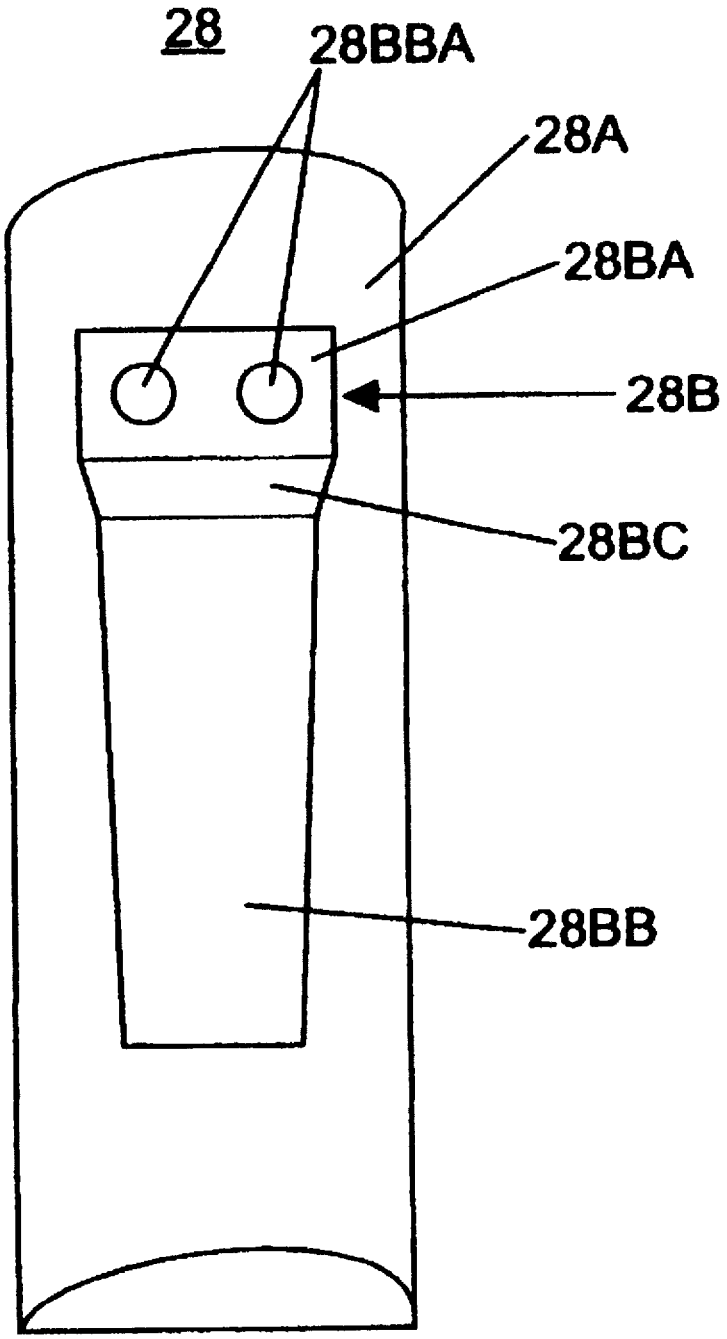
FIG. 4 is a front view of a clip on belt remote unit holder.

Referring to FIG. 4 which is a front view of a clip on belt remote unit holder (28). The remote unit (24) is removably position able within a clip on belt remote unit holder cylinder (28A) of a clip on belt remote unit holder (28) which comprises a clip on belt remote unit holder clip (28B) securely fastened to the clip on belt remote unit holder cylinder (28A) by at least one clip on belt remote unit holder clip top member fastener (28BBA). The clip on belt remote unit holder clip (28B) comprises a clip on belt remote unit holder clip top member (28BA) connected to a clip on belt remote unit holder clip bottom member (28BB) by a clip on belt remote unit holder clip angled member (28BC).

Figure 5:
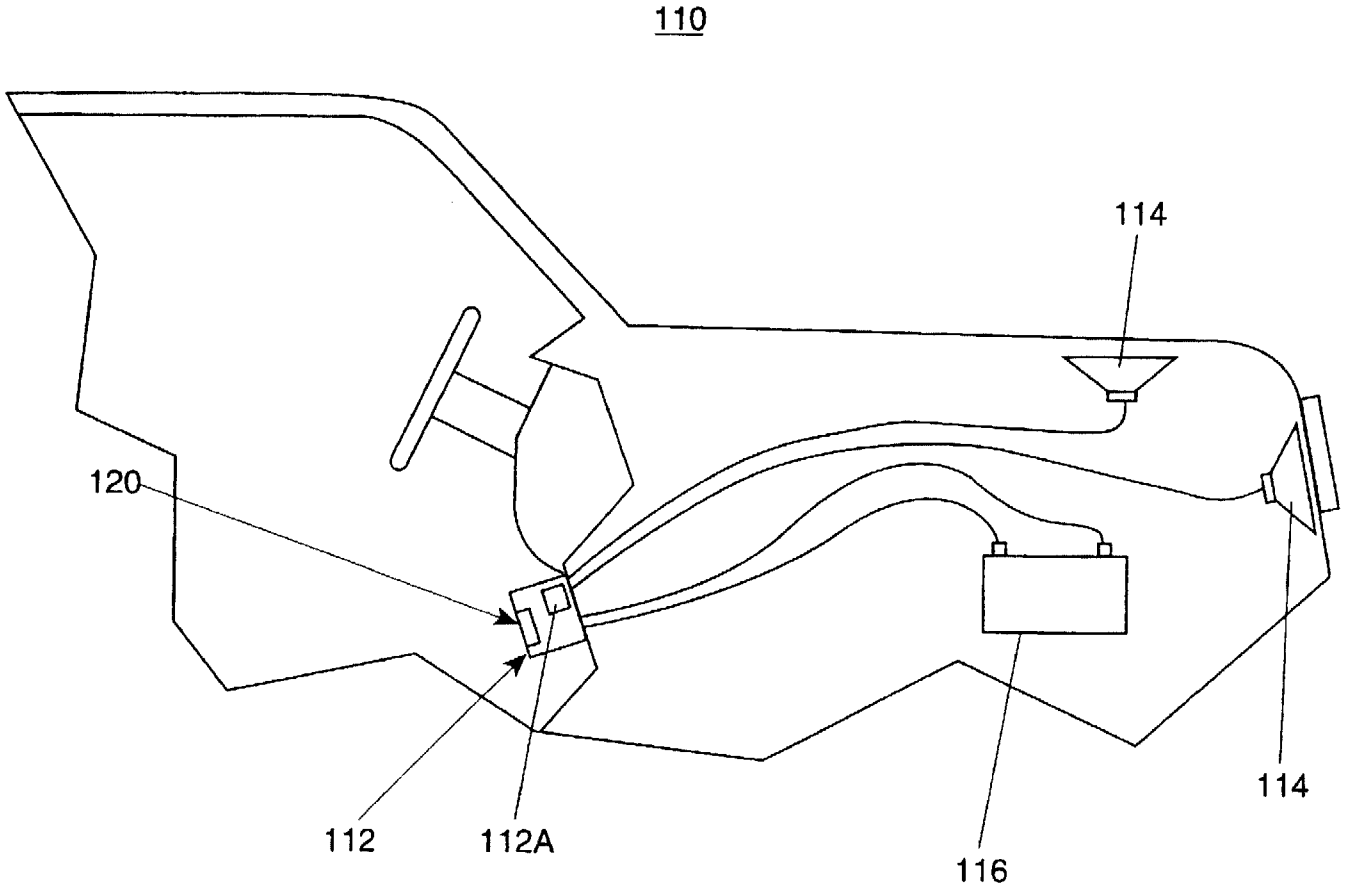
FIG. 5 is a partial cross-sectional view of a vehicle mounted canine auditory transmission apparatus.
Figure 7:
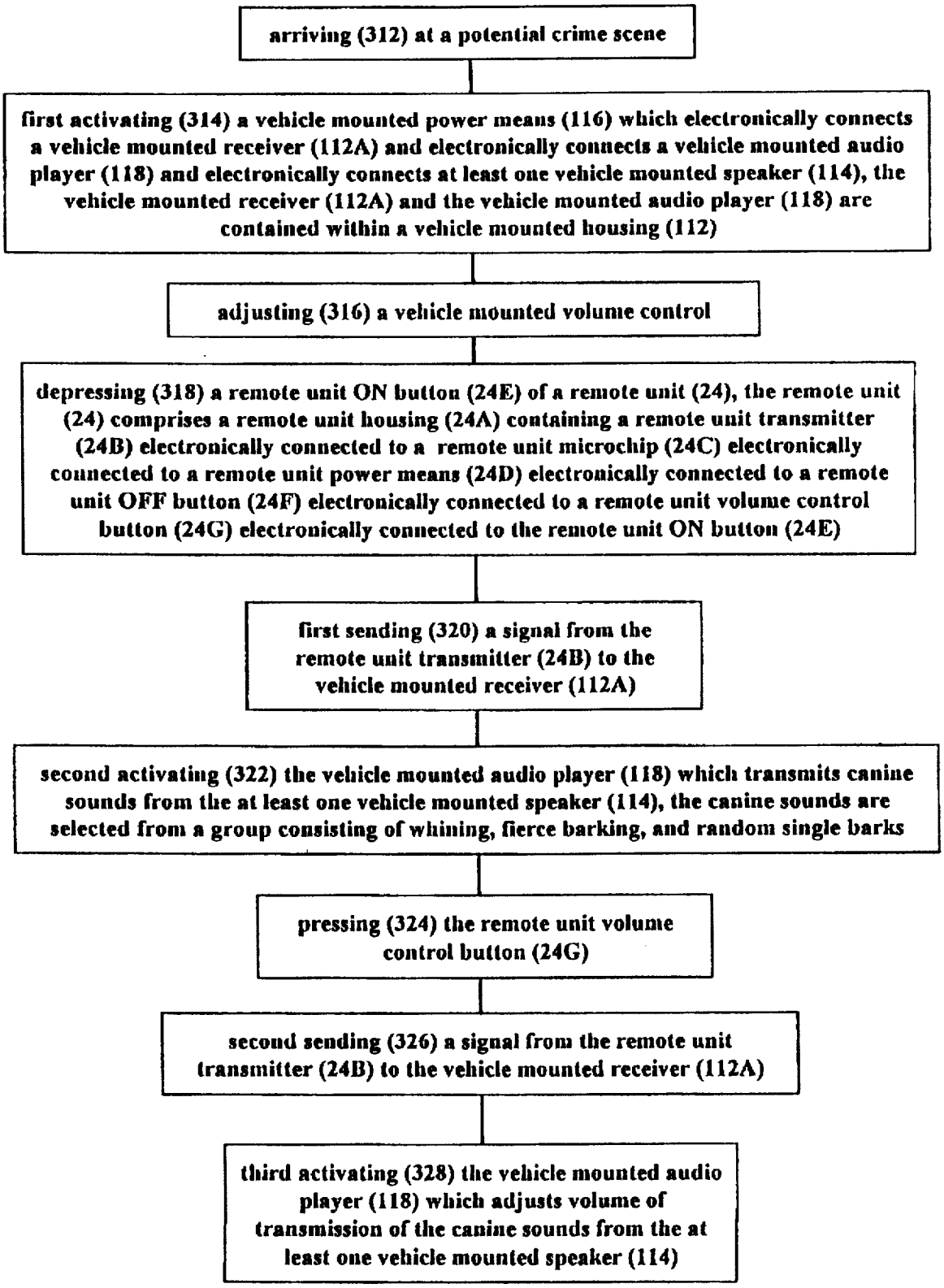
FIG. 7 is a diagrammatic representation of a second method of utilizing a vehicle mounted canine auditory transmission apparatus.

Lastly, referring to FIG. 5 which is a partial cross-sectional view of a vehicle mounted canine auditory transmission apparatus (110) and FIG. 7 which is a diagrammatic representation of a second method (310) of utilizing a vehicle mounted canine auditory transmission apparatus (110). The second method (310) of utilizing a vehicle mounted canine auditory transmission apparatus (110) consisting of the following steps:

a) arriving (312) at a potential crime scene;

B) first activating (314) a vehicle mounted power means (116) which electronically connects a vehicle mounted receiver (112A) and electronically connects a vehicle mounted audio player (118) and electronically connects at least one vehicle mounted speaker (114), the vehicle mounted receiver (112A) and the vehicle mounted audio player (118) are contained within a vehicle mounted housing (112);

C) adjusting (316) a vehicle mounted volume control;

D) depressing (318) a remote unit ON button (24E) of a remote unit (24), the remote unit (24) comprises a remote unit housing (24A) containing a remote unit transmitter (24B) electronically connected to a remote unit microchip (24C) electronically connected to a remote unit power means (24D) electronically connected to a remote unit OFF button (24F) electronically connected to a remote unit volume control button (24G) electronically connected to the remote unit ON button (24E);

E) first sending (320) a signal from the remote unit transmitter (24B) to the vehicle mounted receiver (112A); and F) second activating (322) the vehicle mounted audio player (118) which transmits canine sounds from the at least one vehicle mounted speaker (114), the canine sounds are selected from a group consisting of whining, fierce barking, and random single barks.

The second method (310) of utilizing a vehicle mounted canine auditory transmission apparatus (110), further consists of the steps of:

a) pressing (324) the remote unit volume control button (24G);

B) second sending (326) a signal from the remote unit transmitter (24B) to the vehicle mounted receiver (112A); and C) third activating (328) the vehicle mounted audio player (118) which adjusts volume of transmission of the canine sounds from the at least one vehicle mounted speaker (114).

The vehicle mounted audio player (118) is selected from a group consisting of CD, ROM chip, cassette and digital audio. The vehicle mounted audio player (118) has at least thirty minutes of non-repeating audio sounds contained therein. The at least one vehicle mounted speaker (114) comprises a specification of 85 Db to 102 Db @1w1m, 80 HZ to 18 KHZ, 6" to 8" one way or two way configuration, up to 100 W power handling capability, and having a sufficient amplification of at least 76 dBSPL @8 meters. The remote unit (24) is removably position able within a snap on gun belt remote unit holder cylinder (26A) of a snap on gun belt remote unit holder (26) which comprises a snap on gun belt remote unit holder strap (26B) securely fastened by a snap on gun belt remote unit holder strap fastener (26BC) to the snap on gun belt remote unit holder cylinder (26A). The snap on gun belt remote unit holder strap (26B) comprises a snap on gun belt remote unit holder strap male snap (26BA) positioned at one distal end and a snap on gun belt remote unit holder strap female snap (26BB) positioned at an opposite distal end. The remote unit (24) is removably position able within a clip on belt remote unit holder cylinder (28A) of a clip on belt remote unit holder (28) which comprises a clip on belt remote unit holder clip (28B) securely fastened to the clip on belt remote unit holder cylinder (28A) by at least one clip on belt remote unit holder clip top member fastener (28BBA). The clip on belt remote unit holder clip (28B) comprises a clip on belt remote unit holder clip top member (28BA) connected to a clip on belt remote unit holder clip bottom member (28BB) by a clip on belt remote unit holder clip angled member (28BC).

It will be understood that each of the elements described above, or two or more together, may also find a useful application in other types of constructions differing from the type described above.

While the invention has been illustrated and described as embodied in a canine auditory transmission apparatus, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of utilizing a canine auditory transmission apparatus consisting of the following steps:

a) equipping a police officer with canine auditory transmission apparatus comprising an audio player capable of broadcasting canine sounds that mimic the presence of actual K-9 police dogs and a remote unit capable of activating said player by said police officer;

b) dispatching said police officer to a potential crime scene;

c) said police officer placing, by extending and holding a housing retractable handle, the canine auditory transmission apparatus on a metal surface;

d) allowing a housing magnet of a housing to securely attach to the metal surface and further allowing the housing retractable handle to retract therein;

e) first activating an ON/OFF switch to an ON position which electronically connects a power means to a microchip which is electronically connected to a receiver, the microchip being further electronically connected to at least one speaker and the audio player;

f) checking if a power indicator light is illuminated;

g) adjusting a volume control;

h) depressing a remote unit ON button of a remote unit, the remote unit comprising a remote unit housing containing a remote unit transmitter electronically connected to a remote unit microchip electronically connected to a remote unit power means electronically connected to a remote unit OFF button electronically connected to a remote unit volume control button electronically connected to the remote unit 0N button;

i) sending a signal from the remote unit transmitter to the receiver; and j) activating the audio player which broadcasts said canine sounds to deter and/or prevent a dangerous situation until back-up police officers arrive on the scene.

2. The method of claim 1 in which said audio player is a portable device and said police officer places said device within a patrol car near the left rear door of said car, said car having tinted windows so the public can not see what is on the back seat.

3. The method of claim 2 in which said portable device further includes a CD storage container.

4. The method of claim 3 in which said remote unit is mounted on a belt worn by said police officer.

5. The method of claim 1 in which said audio player is permanently mounted in a patrol car, under the dashboard of said car.

* * * * *